US005135584A

United States Patent [19]

Fujiwara

[11] Patent Number: 5,135,584

[45] Date of Patent: Aug. 4, 1992

[54] PERMANENT MAGNET POWDERS

[75] Inventor: Hajime Fujiwara, Ichihara, Japan

[73] Assignee: Mitsubishi Steel Mfg. Co., Ltd., Tokyo, Japan

[21] Appl. No.: 719,333

[22] Filed: Jun. 21, 1991

[30] Foreign Application Priority Data

Sep. 20, 1990 [JP] Japan ..... 2-248705

[51] Int. Cl.[5] ..... H01F 1/053

[52] U.S. Cl. ..... 148/301; 148/302; 148/303; 420/83; 420/117; 420/121; 420/127

[58] Field of Search ..... 148/301, 302, 303; 420/83, 117, 121, 127

[56] References Cited

U.S. PATENT DOCUMENTS 4,734,131 3/1988 Arai et al. ..... 148/302

FOREIGN PATENT DOCUMENTS 59-222564 12/1984 Japan .
60-1808 1/1985 Japan .
60-31208 2/1985 Japan .
60-144906 7/1985 Japan ..... 148/302
60-224756 11/1985 Japan .
60-224757 11/1985 Japan .
60-224761 11/1985 Japan .
61-123119 6/1986 Japan ..... 148/302

OTHER PUBLICATIONS

Patent Abstracts for 59-222564.
Patent Abstracts for 60-1808.
Patent Abstracts for 60-31208.
Patent Abstracts for 60-224756.
Patent Abstracts for 60-224757.
Patent Abstracts for 60-224761.

*Primary Examiner*—John P. Sheehan
*Attorney, Agent, or Firm*—Flynn, Thiel, Boutell & Tanis

[57] ABSTRACT

Disclosed are permanent magnet powders consisting of the compositional formula:

$$R_xM_ySi_zTa_wT_{100-x-y-z-w} \text{ or}$$

$$R_xM_ySi_zTa_w(T+Q)_{100-x-y-z-w}$$

wherein x, y, z and w are, in atomic percent, $7 \leqq x \leqq 15$, $1 \leqq y \leqq 10$, $0.05 \leqq z \leqq 5.0$ and $0.005 \leqq w \leqq 0.1$; T is essentially Fe or a combination of Fe and Co; Q is at least one element selected from the group consisting of Ti, V, Cr, Mn, Ni, Cu, Zr, Nb, Mo, Hf and W; M is at least one element selected from the group consisting of B, C, Al, Ga, and Ge; and R is at least one element selected from the group consisting of Y and lanthanides. The permanent magnet powders have desirable magnetic properties of good squareness, Hk/iHc of at least 0.45 in a $4\pi I$-H demagnetization curve (wherein Hk is H at $4\pi I = 0.9Br$ in the $4\pi I$-H demagnetization curve and iHc is intrinsic coercive force), and a maximum energy product of at least 15 MGOe combined with sufficient residual magnetic flux density and coercive force.

10 Claims, 3 Drawing Sheets

PERMANENT MAGNET POWDERS

BACKGROUND OF THE INVENTION

1. Field of the Invention

This invention relates to a permanent magnet powder material and, more particularly, to a permanent magnet powder material which has superior magnetic properties such a high coercive force and which can be formed into bonded magnets by being blended with synthetic resin, nonmagnetic metal, etc., or bulk compacted magnets having a full density by consolidation of the powder at high temperatures.

2. Description of the Prior Art

In conventional alloys composed of rare earth elements(R), transition metals(T) and semimetal elements(M), high coercive force permanent magnet powders, the crystal grain size, which is the crystal grain size resulting from recrystallization of an amorphous state, have been disclosed in Japanese Patent Publication No. 1-28489.

In this Japanese Patent Publication, an alloy having a specific composition is amorphized by rapidly cooling from a liquid state or by sputtering ions of the alloy onto a substrate and rapidly cooling the ions. The resultant amorphous alloy material is recrystallized by a heat treatment at an appropriate temperature. In such manner, stable permanent magnet powders having a high coercive force can be obtained.

The magnetic properties of permanent magnet powders made by rapidly cooling an alloy melt may greatly vary depending on the composition and cooling conditions. Among the magnetic properties, the maximum energy product (BH)max is the most important parameter and, in order to increase this parameter, it is necessary to increase the residual magnetic flux density (Br), coercive force (iHc) and squareness of the demagnetization curve.

However, generally, conditions providing a large residual magnetic flux density result in a reduced coercive force. On the other hand, when conditions providing a large coercive force are applied, a lowered residual magnetic flux density results. Therefore, values of maximum energy product are limited to certain levels, taking into consideration these two parameters. In order to obtain a higher level of maximum energy product, it is essential to improve the squareness in a demagnetization curve. Therefore, the proper choice of alloying elements and compositions are very important.

Hk/iHc is used as a parameter for the squareness of a demagnetization curve wherein Hk is the value of H at $4\pi I=0.9Br$ in a demagnetization curve represented by $4\pi I$-H . This relationship is shown in FIG. 3.

SUMMARY OF THE INVENTION

In the present invention, alloys consisting of rare earth elements (R), transition metals (T and, optionally, Q) and semimetal elements (M) have been extensively studied for their alloying elements and compositions and it has been found that when the alloys contains silicon, advantageous magnetic properties of good squareness in the demagnetization curve and significantly increased maximum energy product combined with adequate levels of residual magnetic flux density and coercive force can be obtained by controlling the content of the rare earth elements to a relatively small level and adding a very small amount of tantalum.

Further, it has been found that the transition metal member consisting essentially of Fe can be partially replaced with no more than 25 atomic % Co, while retaining the squareness of the demagnetization curve at high levels.

According to the present invention, there is provided a permanent magnet powder consisting of the compositional formula:

$$R_xM_ySi_zTa_wT_{100-x-y-z-w} \text{ or}$$

$$R_xM_ySi_zTa_w(T+Q)_{100-x-y-z-w'}$$

wherein:

x, y, z and w are, in atomic percent, $7 \leqq x \leqq 15$, $1 \leqq y \leqq 10$, $0.05 \leqq z \leqq 5.0$ and $0.005 \leqq w \leqq 0.1$;

T is essentially Fe or a combination Fe and Co;

Q is at least one element selected from the group consisting of Ti, V, Cr, Mn, Ni, Cu, Zr, Nb, Mo, Hf and W;

M is at least one element selected from the group consisting of B, C, Al, Ga, and Ge; and R is at least one element selected from the group consisting of Y and lanthanides, the permanent magnet powder having a squareness Hk/iHc of at least 0.45 in a $4\pi I$-H demagnetization curve (wherein Hk is H at $4\pi I=0.9Br$ in the $4\pi I$-H demagnetization curve and iHc is intrinsic coercive force) together with a maximum energy product of at least 15 MGOe.

In accordance with the present invention, silicon is added to alloys consisting of rare earth element (R), transition metal (M) and semimetal element (M) together with a very small amount of Ta and the contents of the rare earth elements are controlled to a relatively low level. Using the thus prepared composition, there can be obtained permanent magnet powders having desirable magnetic properties of good squareness in the demagnetization curve and large maximum energy product of at least 15 MGOe together with sufficient residual magnetic flux density and coercive force.

DETAILED DESCRIPTION OF THE PREFERRED EMBODIMENTS

Figure 1:
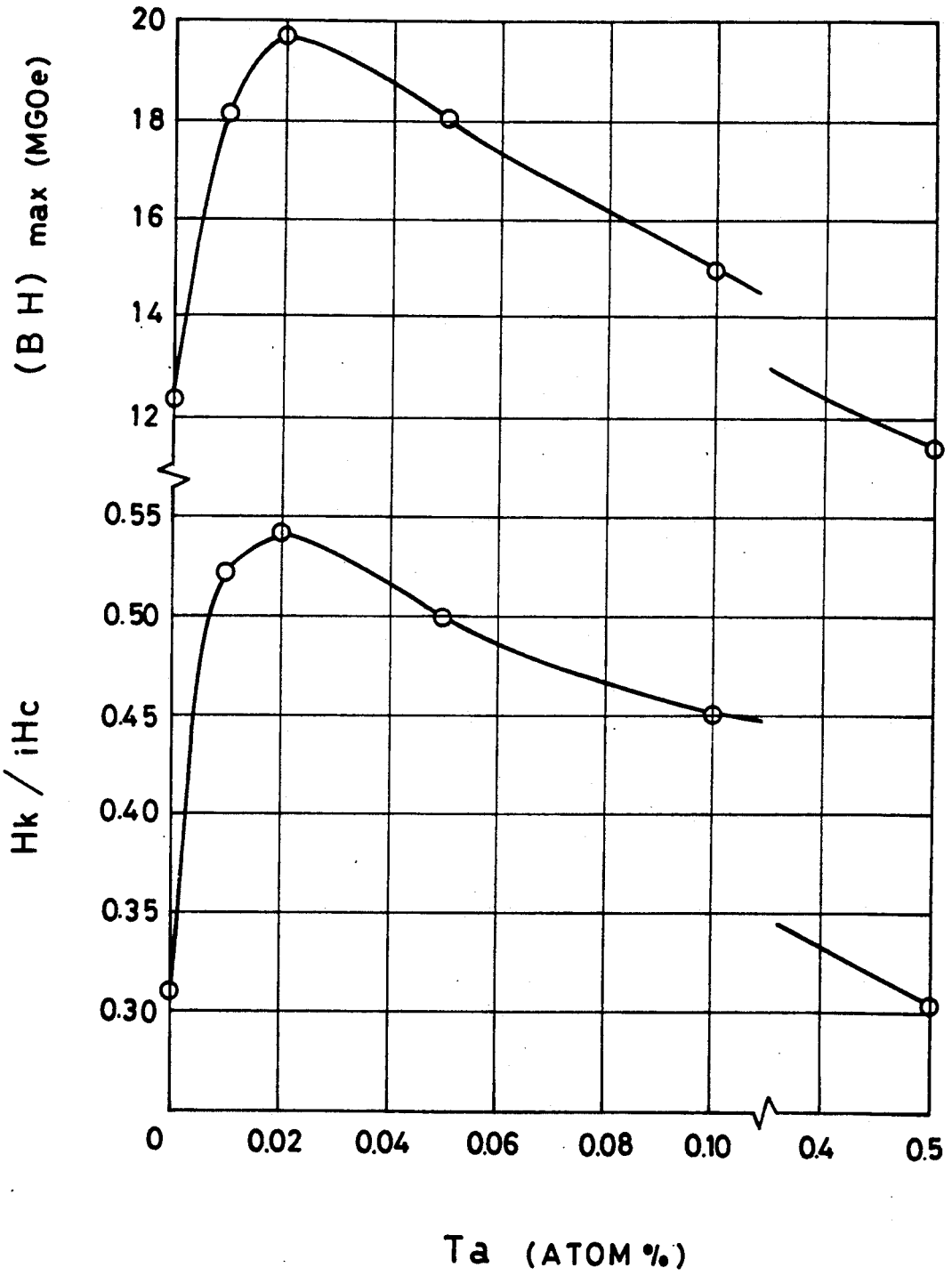
FIG. 1 is a graph illustrating the relationship of Ta content to squareness Hk/iHc in a demagnetization curve and the relationship of Ta content to maximum energy product (BH)max for a permanent magnet powder having a composition shown in Experiment 1.

In the preparation of the permanent magnet powder of the present invention, an alloy melt having a specific composition is rapidly cooled from the molten state to produce thereby an amorphous alloy. The resultant amorphous alloy is recrystallized by a heat treatment at an appropriate temperature to form a permanent magnet powder having a small crystal grain size.

In another method, the permanent magnet powders, which have, substantially a crystal grain size resulting from recrystallization of an amorphous alloy, may be provided by appropriately controlling the cooling rate during the rapid cooling step. Further, these two methods may be combined.

Rare earth elements (R) have been used in an amount of 11 to 65 atom % in conventional alloys in order to obtain permanent magnet materials having high spontaneous magnetization ($\sigma$) and high coercive force. However, in the present invention, a very high squareness of Hk/iHc of at least 0.45 can be obtained with a substantially reduced amount of rare earth elements of 7 to 15 atom % by addition of a very small amount of Ta. A content of the rare earth elements of less than 7 atom % results in a low coercive force which makes the resulting alloy unsuitable for use as permanent magnet powder materials. On the other hand, an excess amount of the rare earth elements exceeding 15 atom % results in an inadequate squareness in the demagnetization curve, although a large coercive force is obtained.

When the content (w) of Ta is less than 0.005 atom %, an improved squareness can not be obtained in the demagnetization curve. However, when the content of Ta exceeds 0.1 atom %, the squareness in the demagnetization curve will be unfavorably affected.

The semimetal element (M) is at least one selected from the group consisting of B, C, Al, Ga and Ge. When the content (y) of these semimetal elements is less than 1 atom %, very severe production conditions must be used to achieve a high coercive force. Therefore, such a small content is undesirable. When the content exceeds 10 atom %, the residual magnetic flux density is reduced and a large maximum energy product can not be obtained.

The transition metal (T) consists essentially of Fe or a combination of Fe and Co (Fe+Co). When Co is used in amount of not greater than 25 atom %, the above-mentioned superior properties can be similarly obtained. Further, Co increases the curie temperature of the alloy and significantly improves the temperature characteristics as permanent magnet powder.

The element (Q) selected from the group consisting of Ti, V, Cr, Mn, Ni, Cu, Zr, Nb, Hf, Mo and W can be also effectively added.

The permanent magnet powder of the present invention has a good squareness of at least 0.45 in the demagnetization curve together with adequate residual magnetic flux density and coercive force values. Therefore, the present invention provides a superior permanent magnet powder having a large maximum energy product of at least 15 MGOe.

Hereinafter, this invention will be illustrated in more detail by the following Experiments and Examples.

Experiment 1

Each alloy having a composition $Nd_9Pr_1B_7Si_{1.0}Ta_w$-$Fe_{82.0-w}$ (wherein w=0, 0.01, 0.02, 0.05, 0.1 or 0.5) was melted in a quartz tube in an argon gas atmosphere. The alloy melt was ejected onto a single copper roll, having an outer diameter of 300 mm and rotating at a rotating rate of 930 rpm, and rapidly cooled on the copper roll to form permanent magnet powder.

Each permanent magnet powder thus obtained was subjected to a pulse magnetization of 60 kOe and its magnetic properties were measured using a vibrating sample magnetometer. FIG. 1 shows the relationship between the Ta content and the squareness Hk/iHc of the demagnetization curve and the relationship between the Ta content and the maximum energy product (BH)max.

It can be seen from FIG. 1 that the squareness of the demagnetization curve is significantly improved by adding a small amount of Ta and the maximum energy product is also improved. When the Ta content exceeded 0.1 atom %, the squareness of the demagnetization curve was reduced below 0.45 and the maximum energy product was also reduced below 15 MGOe.

Experiment 2

Alloys having the compositions listed in Table 1 were rapidly cooled in the same manner as described in Experiment 1 to obtain permanent magnet powders. The resulting permanent magnet powders were examined for their magnetic properties in the same way as in Experiment 1. The squareness Hk/iHc of the demagnetization curve and the maximum energy product (BH)max of each permanent magnet powder are set out in Table 1.

As can be seen from the results shown in Table 1, Si contents in the range of 0.05 to 5.0 atom % resulted in a large squareness of at least 0.45 in the demagnetization curve and a maximum energy product of at least 15 MGOe.

TABLE 1

| No. | Composition (atom %) | iHc (kOe) | Hk (kOe) | Hk/iHc | (BH)max (MGOe) |
|---|---|---|---|---|---|
| *1 | $Nd_2Pr_8B_{8.0}Si_{1.0}Fe_{81.00}$ | 8.5 | 3.7 | 0.43 | 14.5 |
| *2 | $Nd_2Pr_8B_{7.5}Ta_{0.03}Fe_{82.47}$ | 8.1 | 3.6 | 0.44 | 14.8 |
| 3 | $Nd_2Pr_8B_{7.0}Si_{0.1}Ta_{0.03}Fe_{82.87}$ | 10.2 | 5.6 | 0.55 | 18.5 |
| 4 | $Nd_4Pr_6B_{8.0}Si_{0.5}Ta_{0.02}Fe_{81.48}$ | 9.8 | 5.4 | 0.55 | 18.0 |
| 5 | $Nd_4Pr_6B_{7.5}Si_{2.0}Ta_{0.03}Fe_{80.47}$ | 10.6 | 5.4 | 0.51 | 17.1 |
| 6 | $Nd_6Pr_4B_{7.0}Si_{4.0}Ta_{0.02}Fe_{78.98}$ | 9.9 | 4.6 | 0.46 | 15.5 |
| *7 | $Nd_6Pr_4B_{7.0}Si_{8.0}Ta_{0.03}Fe_{74.97}$ | 9.5 | 3.8 | 0.40 | 12.6 |

Remark* Composition outside the scope of the invention

EXAMPLES 1 TO 10

Various alloys having the compositions shown in Table 2 were melted in a quartz tube in an argon gas atmosphere. Each alloy melt was ejected onto a single copper roll with an outer diameter of 300 mm, rotating at a rotating speed of 950 rpm, and rapidly cooled to obtain permanent magnet powder. The resultant permanent magnet powder was sealed within a quartz tube under an argon gas pressure of about 700 Torr and heated at 400 ° C. for 1 hour. The thus heat-treated permanent magnet powder was subjected to a pulse magnetization of 60 kOe and examined for its magnetic properties, using a vibrating sample magnetometer. The results are set out in Table 2.

It can be seen that addition of Si and a very small amount of Ta to alloys consisting of rare earth elements, transition metal and semimetal element resulted in a high degree of squareness in their demagnetization curves combined with a large maximum energy product of at least 15 MGOe.

TABLE 2

| No. | Composition (atom %) | iHc (kOe) | Hk (kOe) | Hk/iHc | (BH)max (MGOe) |
|---|---|---|---|---|---|
| 1 | $Nd_2Pr_8B_4Si_{4.0}Ta_{0.02}Fe_{81.98}$ | 9.1 | 5.1 | 0.56 | 16.2 |
| 2 | $Nd_2Pr_8C_8Si_{0.2}Ta_{0.02}Fe_{81.78}$ | 8.2 | 4.0 | 0.49 | 15.1 |
| 3 | $Nd_2Pr_6B_6Si_{0.3}Ta_{0.03}Fe_{85.67}$ | 7.7 | 4.6 | 0.60 | 15.5 |
| 4 | $Nd_8Pr_6B_6Si_{0.2}Ta_{0.03}Fe_{79.77}$ | 13.1 | 6.0 | 0.46 | 16.5 |
| 5 | $Nd_2Pr_8Al_1B_6Si_{0.4}Ta_{0.06}Fe_{82.54}$ | 10.9 | 5.0 | 0.46 | 17.6 |
| 6 | $Nd_{10}La_1Ga_1B_7Si_{0.6}Ta_{0.04}Fe_{80.36}$ | 10.0 | 4.6 | 0.46 | 15.6 |
| 7 | $Pr_{10}Ce_1Ge_1B_7Si_{0.8}Ta_{0.02}Fe_{80.18}$ | 8.6 | 4.0 | 0.47 | 15.5 |
| 8 | $Nd_7Tb_3B_6Si_{1.0}Ta_{0.05}Fe_{82.95}$ | 13.5 | 6.2 | 0.46 | 15.4 |
| 9 | $Pr_7Dy_3B_7Si_{0.5}Ta_{0.05}Fe_{82.45}$ | 12.1 | 6.3 | 0.52 | 17.2 |
| 10 | $Pr_7Ho_3B_8Si_{0.2}Ta_{0.05}Fe_{81.75}$ | 13.3 | 6.7 | 0.50 | 16.3 |

EXAMPLE 11 TO 22

Alloys having the compositions shown in Table 3 were melted in a quartz tube in an argon gas atmosphere. Each alloy melt was ejected onto a single copper roll with an outer diameter of 300 mm, rotating at a rotating speed of 500 to 1500 rpm, and rapidly cooled to obtain permanent magnet powder.

The thus obtained permanent magnet powder was subjected to a pulse magnetization of 60 kOe and examined for its magnetic properties, using a vibrating sample magnetometer. Table 3 shows the magnetic properties at the rotating rate providing the highest level of maximum energy product for each composition. It is clear from the results that also in case where one or more elements selected from the group (Q) consisting of Ti, V, Cr, Mn, Ni, Cu, Zr, Nb, Mo, Hf and W are added together with the transition metal element (T) consisting essentially of Fe or a combination of Fe and Co, and high squareness in the demagnetization curve can be also squareness in the demagnetization curve can be also obtained together with a high coercive force and a high maximum energy product of at least 15 MGOe.

TABLE 3

| No. | Composition (atom %) | iHc (kOe) | Hk (kOe) | Hk/iHc | (BH)max (MGOe) |
|---|---|---|---|---|---|
| 11 | $Nd_5Pr_5B_6Si_{0.5}Ta_{0.02}Ti_1Fe_{82.48}$ | 10.5 | 5.4 | 0.51 | 17.9 |
| 12 | $Nd_5Pr_5B_7Si_{0.3}Ta_{0.02}V_1Fe_{81.68}$ | 10.8 | 5.8 | 0.54 | 18.8 |
| 13 | $Nd_5Pr_5B_8Si_{0.1}Ta_{0.03}Cr_2Fe_{79.87}$ | 9.1 | 4.3 | 0.47 | 15.5 |
| 14 | $Nd_{5.5}Pr_5B_6Si_{0.5}Ta_{0.03}Mn_2Fe_{80.97}$ | 9.5 | 4.9 | 0.52 | 15.6 |
| 15 | $Nd_{5.5}Pr_5B_7Si_{0.3}Ta_{0.05}Ni_8Fe_{74.15}$ | 9.0 | 4.5 | 0.50 | 16.5 |
| 16 | $Nd_{5.5}Pr_5B_8Si_{0.1}Ta_{0.05}Cu_4Fe_{77.35}$ | 9.0 | 4.4 | 0.49 | 16.1 |
| 17 | $Nd_5Pr_{5.5}B_6Si_{0.5}Ta_{0.02}Zr_1Fe_{81.98}$ | 12.0 | 6.1 | 0.51 | 18.0 |
| 18 | $Nd_5Pr_{5.5}B_7Si_{0.3}Ta_{0.02}Nb_1Fe_{81.18}$ | 11.5 | 5.4 | 0.47 | 15.7 |
| 19 | $Nd_5Pr_{5.5}B_8Si_{0.1}Ta_{0.02}Mo_1Fe_{80.38}$ | 10.4 | 5.2 | 0.50 | 16.6 |
| 20 | $Nd_{4.5}Pr_{5.5}B_7Si_{0.2}Ta_{0.01}Hf_1Fe_{81.79}$ | 10.7 | 5.9 | 0.55 | 19.1 |
| 21 | $Nd_{5.5}Pr_{4.5}B_7Si_{0.2}Ta_{0.01}W_1Fe_{81.79}$ | 10.9 | 5.2 | 0.48 | 16.3 |
| 22 | $Nd_{10}B_7Si_{0.2}Ta_{0.02}V_1Nb_1Fe_{80.78}$ | 10.7 | 5.9 | 0.55 | 17.0 |

EXAMPLE 23

Figure 2:
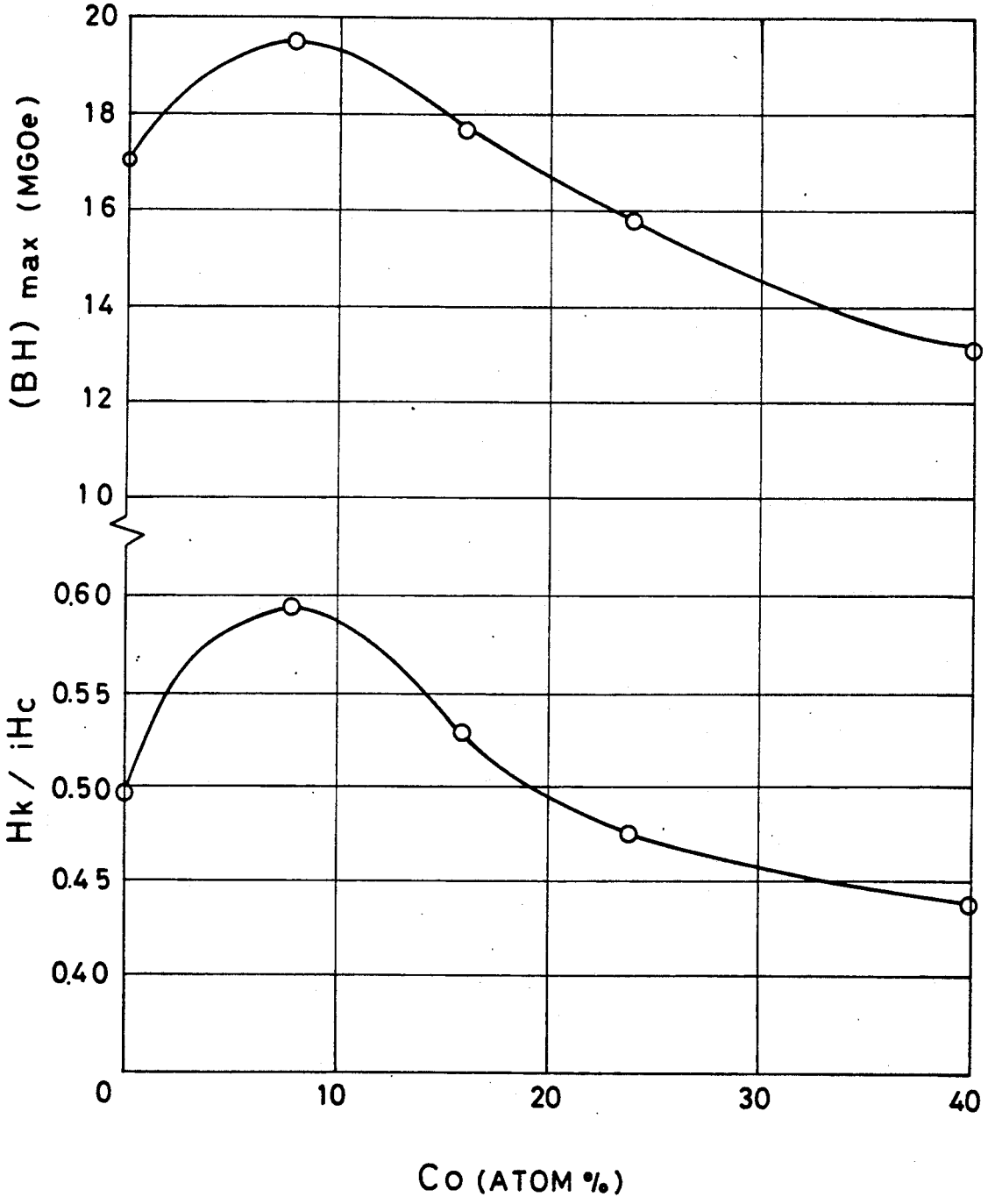
FIG. 2 is a graph illustrating the relationship of Co content to squareness Hk/iHc in a demagnetization curve and the relationship of Co content to maximum energy product (BH)max for a permanent magnet powder having a composition shown in Example 23.
Figure 3:
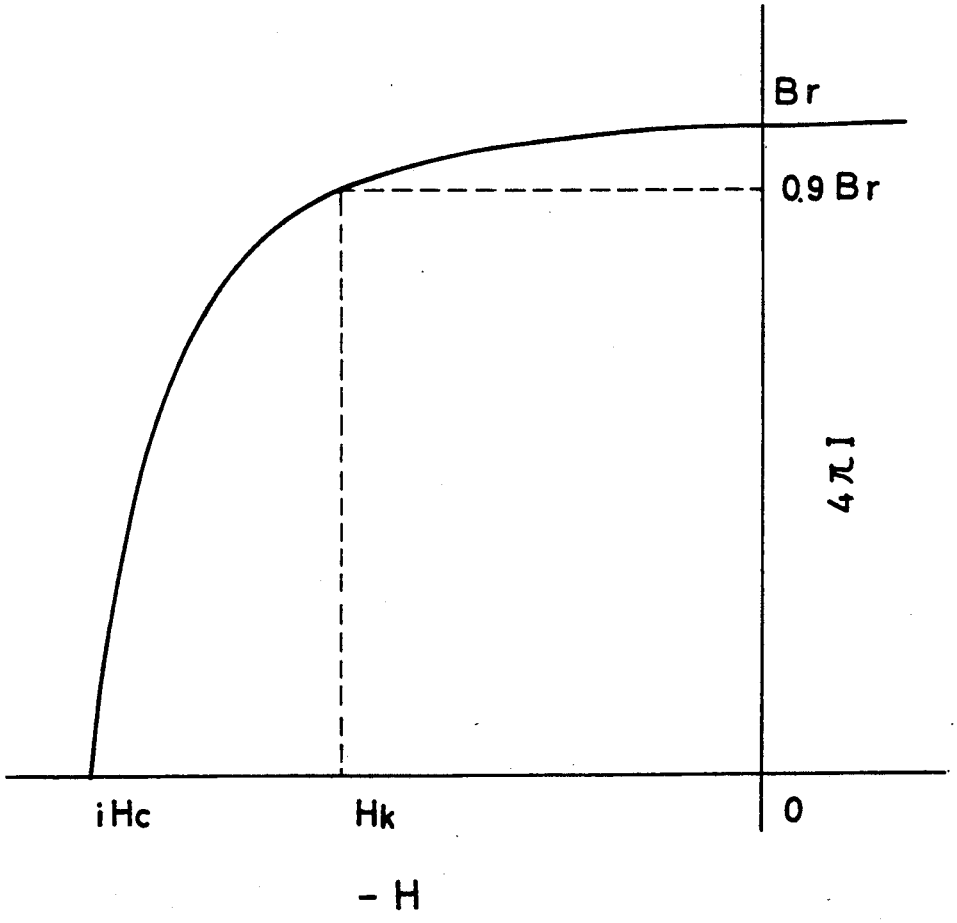
FIG. 3 is a graph schematically illustrating squareness in a demagnetization curve.

Alloys having compositions consisting of the formula $Nd_2Pr_{8.5}B_{7.8}Si_{0.1}Ta_{0.02}V_{0.8}Co_vFe_{80.78-v}$ (wherein v=0, 8, 16, 24 or 40) were melted in a quartz tube in an argon gas atmosphere. The alloy melts were ejected onto a single copper roll with an outer diameter of 300 mm, rotating at a rotating rate of 920 rpm, and rapidly cooled to obtain permanent magnet powders. The thus obtained permanent magnet powders were measured for their magnetic properties, using a vibrating sample magnetometer. FIG. 2 shows the relationship between the Co content and the squareness Hk/iHc in the demagnetization curve and the relationship between the Co content and the maximum energy product (BH)max, for each permanent magnet powder.

As can be seen from the results, when Co is contained as the transition metal (T), up to 25 atom % of Co can provide similar superior squareness in the demagnetization curve as well as high maximum energy product.

Example 24

An alloy having a composition of $Nd_{7.6}Pr_{1.9}B_{7.5}Si_{0.2}$-$_5Ta_{0.02}V_1Co_{8.2}Fe_{73.53}$ was melted in a high-frequency melting furnace in an argon gas atmosphere and the resultant alloy melt was ejected onto a single copper roll with an outer diameter of 300 mm, rotating at a rate of 928 rpm, to be rapidly cooled. The thus obtained permanent magnet powder was subjected to a pulse-magnetization of 60 kOe and measured for its magnetic properties, using a vibrating sample magnetometer.

The following results were obtained. $\sigma r=98.5$ emu/g, iHc=10.2 kOe, Hk=5.6 kOe, Hk/iHc=0.55 and (BH)max=19.6 MGOe 98.5 weight % of the permanent magnet powder was blended with 1.5 weight % of epoxy resin and compacted under a pressure of 10 t/cm$^2$. The compacted body was hardened at 150 ° C. for 30 minutes to form a bonded magnet. The resultant bonded magnet exhibited the following properties.

Br=7.8 kG, iHc=10.2 kOe and (BH)max=13.8 MGOe

What is claimed is:

1. A permanent magnet powder consisting of the compositional formula:

$$R_xM_ySi_zTa_wT_{100-x-y-z-w}$$

wherein:

x, y, z and w are, in atomic percent, $7 \leqq x \leqq 15$, $1 \leqq y \leqq 10$, $0.05 \leqq z \leqq 5.0$ and $0.005 \leqq w \leqq 0.1$;

T is essentially Fe or a combination of Fe and Co;

M is at least one element selected from the group consisting of B, C, Al, Ga, and Ge; and R is at least one element selected from the group consisting of Y and lanthanides, the permanent magnet powder having a squareness Hk/iHc of at least 0.45 in a $4\pi I$-H demagnetization curve (wherein Hk is H at $4\pi I=0.9Br$ in the $4\pi I$-H demagnetization curve and iHc is intrinsic coercive force) together with a maximum energy product of at least 15 MGOe.

2. A permanent magnet powder consisting of the compositional formula:

$$R_xM_ySi_zTa_w(T+Q)_{100-x-y-z-w}$$

wherein:

x, y, z and w are, in atomic percent, $7 \leqq x \leqq 15$, $1 \leqq y \leqq 10$, $0.05 \leqq z \leqq 5.0$ and $0.005 \leqq w \leqq 0.1$;

T is essentially Fe or a combination of Fe and Co;

Q is at least one element selected from the group consisting of Ti, V, Cr, Mn, Ni, Cu, Zr, Nb, Mo, Hf and W;

M is at least one element selected from the group consisting of B, C, Al, Ga, and Ge; and R is at least one element selected from the group consisting of Y and lanthanides, the permanent magnet powder having a squareness Hk/iHc of at least 0.45 in a $4\pi I$-H demagnetization curve (wherein Hk is H at $4\pi I=0.9Br$ in the $4\pi I$-H demagnetization curve and iHc is intrinsic coercive force) together with a maximum energy product of at least 15 MGOe.

3. The permanent magnet powder of claim 1, consisting of an alloy of the formula $Nd_2Pr_8B_{7.0}Si_{0.1}Ta_{0.03}Fe_{82.87}$.

4. The permanent magnet powder of claim 1, consisting of an alloy of the formula $Nd_4Pr_6B_{8.0}Si_{0.5}Ta_{0.02}Fe_{81.48}$.

5. The permanent magnet powder of claim 1, consisting of an alloy of the formula $Nd_4Pr_6B_{7.5}Si_{2.0}Ta_{0.03}Fe_{80.47}$.

6. The permanent magnet powder of claim 1, consisting of an alloy of the formula $Pr_7Dy_3B_7Si_{0.5}Ta_{0.05}Fe_{82.45}$.

7. The permanent magnet powder of claim 2, consisting of an alloy of the formula $Nd_{4.5}Pr_{5.5}B_7Si_{0.2}Ta_{0.01}Hf_1Fe_{81.79}$.

8. The permanent magnet powders of claim 2, consisting of an alloy of the formula $Nd_{7.6}Pr_{1.9}B_{7.5}Si_{0.25}Ta_{0.02}V_1Co_{8.2}Fe_{73.53}$.

9. The permanent magnet powder of claim 1, where T is a combination of Fe and Co, with the proviso that Co is not present in an amount greater than 25 atomic percent.

10. The permanent magnet powder of claim 2, where T is a combination of Fe and Co, with the proviso that Co is not present in an amount greater than 25 atomic percent.

* * * * *